United States Patent [19]

Gornstein et al.

[11] 3,946,688

[45] Mar. 30, 1976

[54] HYDRODYNAMIC SECTIONS

[75] Inventors: Robert J. Gornstein; Kenneth R. Meldahl, both of Bellevue, Wash.

[73] Assignee: The Boeing Company, Seattle, Wash.

[22] Filed: Nov. 12, 1973

[21] Appl. No.: 414,992

Related U.S. Application Data

[63] Continuation of Ser. No. 207,414, Dec. 13, 1971, abandoned.

[52] U.S. Cl. ..... 114/66.5 H

[51] Int. Cl.[2] ..... B63B 1/18

[58] Field of Search ..... 114/66.5 H, 66.5 R; 244/35 R, 35 A

[56] References Cited

UNITED STATES PATENTS

| | | | |
|---|---|---|---|
| 1,480,327 | 1/1924 | Wisenant | 244/35 R |
| 1,752,378 | 4/1930 | Gobble | 244/35 R |
| 2,123,096 | 7/1938 | Charpentier | 244/35 R |
| 3,343,512 | 9/1967 | Rasmussen | 114/66.5 H |
| 3,756,540 | 9/1973 | Williams | 244/35 R |

OTHER PUBLICATIONS

Numachi; "Cavitation Tests on Hydrofoils . . ;" *Journal of Basic Engineering;* 9-1969; pp. 423-424.

*Primary Examiner*—Trygve M. Blix
*Assistant Examiner*—Stuart M. Goldstein
*Attorney, Agent, or Firm*—Christensen, O'Connor, Garrison & Havelka

[57] ABSTRACT

A method of designing hydrodynamic sections having improved characteristics is described wherein a desired pressure profile and boundary layer conditions for the surface of an undefined section are established at operating velocities for the section and a hydrodynamic section is analytically designed to provide the desired characteristics. One preferred embodiment of the hydrodynamic section meeting the established pressure profile and boundary layer conditions is disclosed having a flat bottom and upper surface defined by a plurality of circular arcs.

3 Claims, 11 Drawing Figures

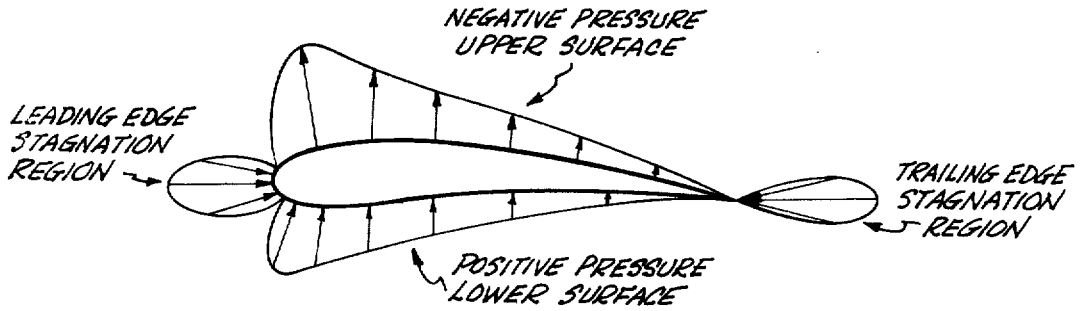
Fig. 1. AIRFOIL SECTION
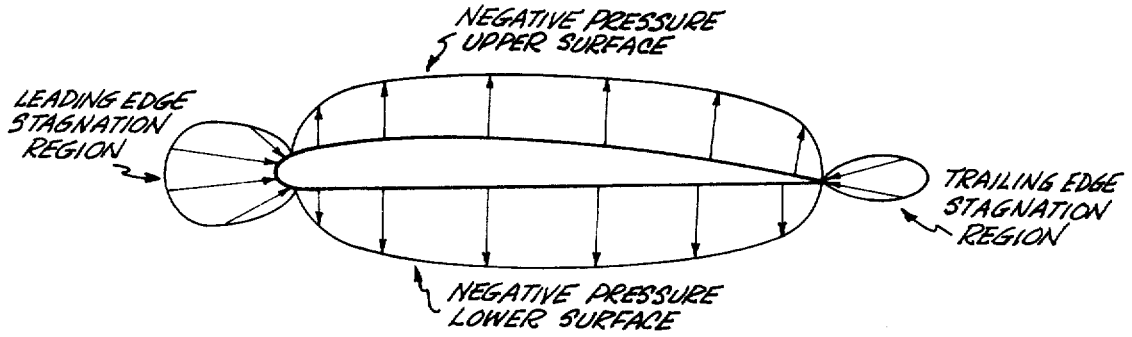
Fig. 2. HYDROFOIL SECTION
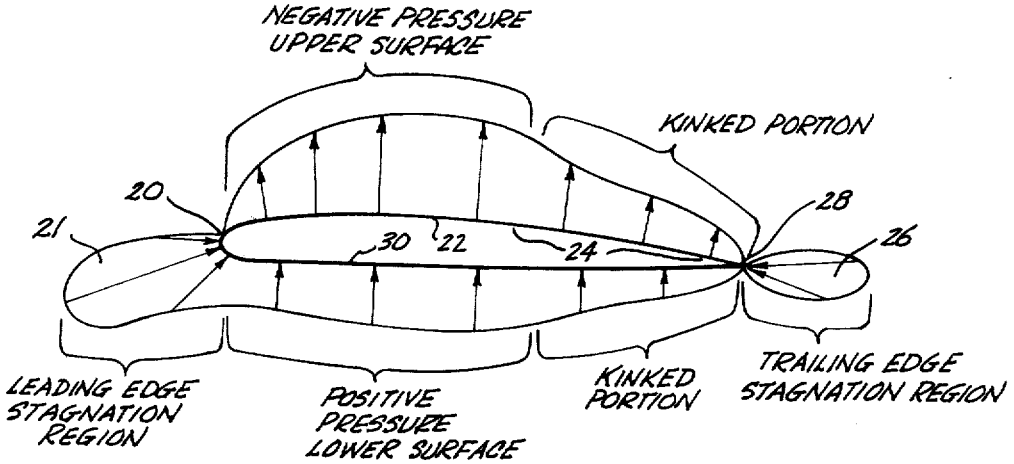
Fig. 3. HYDRODYNAMIC FOIL SECTION

CALCULATED TWO-DIMENSIONAL FIRST ORDER PROFILE DRAG

FLAT BOTTOM FOIL SECTION (FIG. 8.)

$h/c = 1.$ $C_l \sim .2$ $\alpha = .5$

ESTIMATED FLAP HINGE MOMENT COEFFICIENTS AND FLAP LIFT COEFFICIENTS

| | | |
|---|---|---|
| $C_{l_f} \sim .064$ | $C_h \sim -.018$ | BASED ON FLAP CHORD |
| $C_{l_{f\alpha}} \sim .021/\text{DEG}$ | $C_{h_\alpha} \sim -.006/\text{DEG}$ | |
| $C_{l_{f\gamma}} \sim .045/\text{DEG}$ | $C_{h_\gamma} \sim -.011/\text{DEG}$ | |

NACA 16-30(7.5) AT $h/c = 1.$ $C_l \sim .17$ (SHOWN FOR COMPARISON ONLY)
FOR REFERENCE: $C_h \sim -.068$

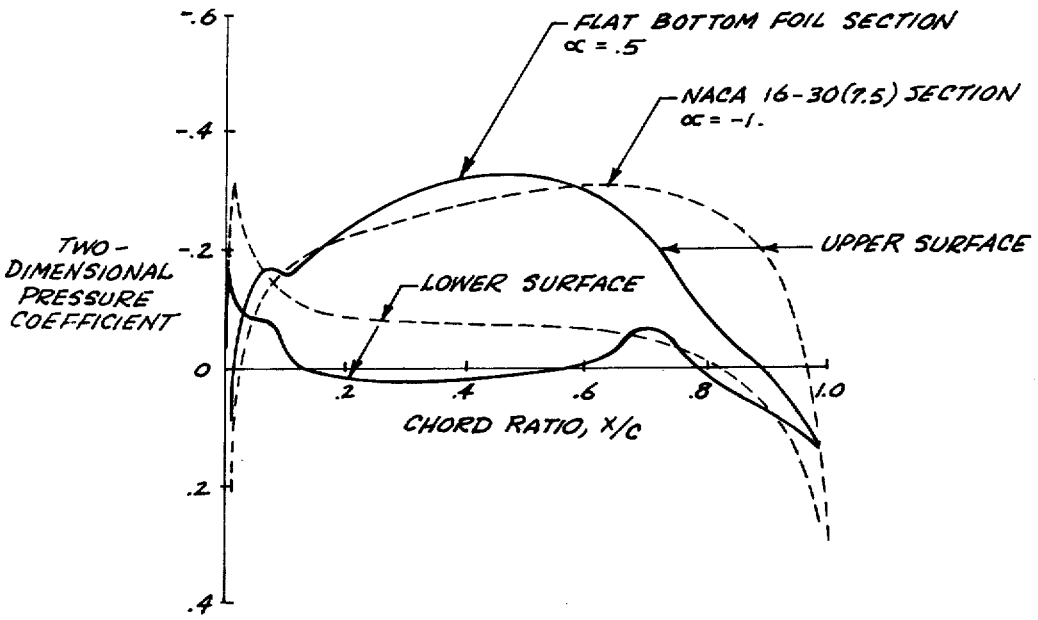

CALCULATED TWO-DIMENSIONAL PRESSURE DISTRIBUTIONS

Fig. 11.

HYDRODYNAMIC SECTIONS

CROSS-REFERENCE TO RELATED APPLICATIONS

This application is a continuation of U.S. patent application Ser. No. 207,414, filed Dec. 13, 1971, by Robert J. Gornstein et al. and entitled HYDRODYNAMIC SECTIONS and now abandoned.

BACKGROUND OF THE INVENTION

Hydrofoils are well known as one means of supporting boats during travel across water to provide improved ride characteristics and decrease power requirements as compared to conventional hull boats. Heretofor several designs for the hydrofoil sections have been proposed for use in such applications. These designs were developed for application to aircraft propeller and wing sections for the express purpose of delaying compressability effect which were deemed detrimental to the aircraft's performance. Comparison of wind tunnel tests of the prior art hydrodynamic sections indicates that a significant improvement in lift-to-drag ratio at low Reynolds number is achieved by design wherein compressability effects are delayed. One of such hydrodynamic sections is known as NACA 16–XXX series which has been found to have the most desirable characteristics of the prior art hydrofoil sections including low supervelocity on the upper surface.

Some of the characteristics of the 16–XXX series are not desirable when considered from the standpoint of hydrodynamic application at full scale Reynolds numbers, namely the large negative pressure near the leading edge and the steep positive pressure gradient at the trailing edge which makes the section susceptable to flow variations including cavitation and boundary layer separation. The sensitivity of the flow to surface imperfections also can adversely effect the vehicle ride quality and operability. Aerodynamic sections proposed heretofor for usage in the environment where hydrofoils operate similarly do not offer the potential for significant improvement in operability and in ride quality.

Applications of hydrofoil systems to boats are well known in the art; however, heretofor the primary effort in the development of the technology has been toward establishing the control systems and methods of hydrofoil attachment, strut design, propulsion systems and the like. An example of a thorough treatment of such hydrofoil systems for boats appears in U.S. Pat. No. 3,465,704 to Baker wherein a hydrofoil system having control mechanisms and means to adjust the attitude and location of the hydrofoil elements is disclosed. This reference also provides helpful mathematical and computerized analysis of various components of the hydrofoil system. It is incorporated herein by reference for purposes of indicating the background of the invention and illustrating the state of the art.

OBJECTS OF THE INVENTION

It is one object of this invention to provide a means for designing the hydrodynamic section for a hydrofoil having optimum operating characteristics.

Another object of this invention is to provide a method of designing a hydrodynamic section and the section so designed which is less susceptible to flow variations including cavitation and boundary layer separation.

It is still another object of this invention to provide a means for designing the hydrodynamic section of a hydrofoil according to a predetermined velocity induced pressure profile.

It is a further object of this invention to define a hydrodynamic section for a hydrofoil wherein the surface exhibits increased resistance to unwetting and minimum force fluctuation when unwetting occurs along with improved boundary layer flow profile drag and increased resistance to boundary layer separation for the range of full scale Reynolds numbers encountered in hydrofoil operation.

It is a still further object of this invention to provide a hydrodynamic section having increased lift capability for a given thickness ratio and speed.

SUMMARY OF THE INVENTION

The method of designing hydrodynamic sections disclosed herein utilizes well known analytical computer programs written to solve problems occurring in the aerospace and hydrospace industries along with experimental data obtained during operation of hydrofoil systems known heretofor. In order to define the pressure distribution and boundary layer characteristics deemed desirable for full scale hydrofoil application to establish the hydrodynamic section desired, a pressure profile for a hydrodynamic section traveling through a liquid at a given design velocity was established wherein the profile has a positive pressure zone at the leading edge of the section, a negative pressure zone over an upper surface of the section with a kinked segment in the pressure profile at a rearwardly disposed segment of the upper surface providing lowered negative pressures to control cavitation, a positive pressure zone over the entire lower surface of the section again with a kinked segment in the pressure profile over a rearwardly disposed segment of the lower surface in which lowered positive pressures are observed, again to control cavitation. A positive pressure zone also is to be established at the trailing edge of the section. Having the pressure profile meeting the above stated design criteria, a hydrodynamic section which will exhibit these characteristics was analytically evolved using computer techniques. One hydrodynamic section which was found to meet the design criteria is a section which has a major portion of the bottom surface flat with a major portion of the upper surface defined by a plurality of circular arcs.

These and other objects, attributes and features of this invention will be more readily apparent from an evaluation of the following detailed discussion of the preferred embodiment taken in conjunction with the appended drawings and the claims.

In the drawings:

FIG. 1 shows a pressure profile for a typical prior art airfoil section.

FIG. 2 shows a pressure profile diagram of a typical prior art hydrofoil section.

FIG. 3 shows a pressure profile diagram for use in designing a hydrodynamic foil section taught by this invention.

FIG. 9 shows one example of the NACA 16–XXX series of hydrofoils for comparison purposes.

FIG. 11 is a calculated two-dimensional pressure distribution for the hydrofoil section shown in FIG. 8.

DETAILED DESCRIPTION OF THE PREFERRED EMBODIMENTS

Figure 4:
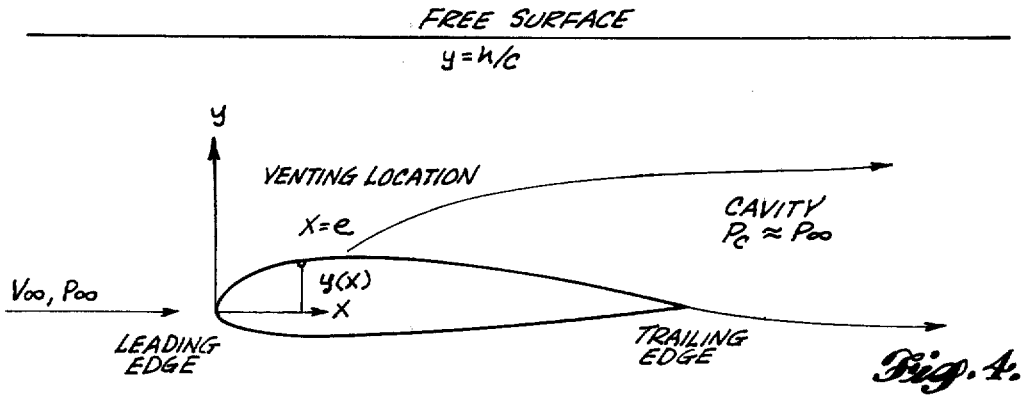
FIG. 4 shows an actual hydrofoil plane wherein cavitation occurs.

The method for establishing a section with the above improvements utilizes available analytical computer programs and experimental data in order to define the pressure distribution and boundary layer characteristics deemed desirable for full scale hydrofoil application. Starting with an uncambered section, a pressure distribution was defined which had certain requirements differing from the pressure profile known for hydrofoils such as NACA 16–XXX shown in FIGS. 2 and 9. The negative pressure near the leading edge of the 16–XXX series sections are large making them susceptible to leading edge cavitation due to angle of attack fluctuations. In order to improve this situation the pressure coefficient and gradient over the forward portion of the proposed section was altered.

The pressure gradients over the rear portion of the 16–XXX series section remains negative up to 60% of the chord and then rapidly increases as the trailing edge is approached. This type of pressure distribution is particularly sensitive to turbulent separation over the range of full scale Reynolds number due to the rapid deceleration of the flow which de-energizes the boundary layer so that it can no longer follow the surface. This would be further aggravated when the trailing edge flap is used, the flow being more prone to separate on the side of the section opposite to the deflection of the flap. For the example section the pressure distribution over the rear portion of the chord was adjusted to gradually decelerate the flow, thereby reducing the possibility of turbulent separation. The resulting pressure distribution contains a concave or kinked region over the rear portion of the section. This characteristic concave region results from the criteria for the prevention or delay of turbulent separation. The extent and gradient of the pressures in this region depend on the Reynolds number range the section is required to operate in. Another effect of this distribution is to stabilize the location of laminar to turbulent transition at a more favorable position on the section from the standpoint of profile drag.

FIG. 3 describes the pressure field about the hydrodynamic section of this invention. For a lifting surface operating at its design angle of attack near the free surface the following characteristics are embodied in this invention.

1. The pressure decreases gradually across the upper surface from the position of stagnation pressure 21 near the leading edge 20 to a negative section near the middle 22. The magnitude of minimum negative pressure is defined by the vapor pressure of the fluid. The pressure on the after portion 24 of the section increases gradually from the minimum negative pressure near the middle to a positive value near the trailing edge stagnation region 26.

2. The pressure distribution on the after portion of the section contains a concave or kinked portion. The purpose of this kink is to stabilize the boundary layer transition region making it insensitive to fluctuations in the flow due to wave orbital velocities; it also acts to prevent separation of the flow. The shape and extent of the kink are defined by the Reynolds number range the section is designed to operate over.

3. The pressure on the lower surface 30 decreases gradually from stagnation pressure near the leading edge to a minimum positive value near the middle of the section. The pressure distribution on the after portion gradually decreases from the minimum positive pressure near the middle to the trailing edge 28. The lower surface pressure distribution may also contain a kinked portion. The magnitude of the lower surface pressure is determined by the lift desired from the section. Since the minimum suction on the upper surface is limited by vapor pressure a significant portion of the lift is generated by the lower surface.

4. The pressure distribution on both sides of a symetrical strut section will be similar to the foil upper surface pressure distribution.

FIG. 1 shows the pressure distribution on a typical airfoil section for comparison.

FIG. 2 shows the pressure distribution on a typical hydrofoil section for comparison.

The following theory describes a method of obtaining sections with the desired characteristics.

LINEARIZED THEORY

Considering that steady two-dimensional, incompressible, and irrotational flow exists everywhere in the physical plans outside the foil cavity, it is possible to assume that a complex velocity function, $\omega = V_x - iV_y$, exists, where $\omega$ is the complex total velocity function, $V_x$ is the total horizontal velocity component, and $V_y$ is the total vertical velocity component. The complex total velocity function, $\omega$ is known from elementary fluid mechanics and may be obtained as follows: Let $\phi$ and $\psi$ be the velocity potential and stream function of an incompressible, irrotational, steady two-dimensional fluid. Defining $Q = \phi + i\psi$ as the complex potential and taking the partial derivatives with respect to $x$, the following is obtained:

$$\frac{\delta Q}{\delta x} = \frac{\delta \phi}{\delta x} + \frac{i\delta\psi}{\delta x} = \frac{dQ}{dz}\ \frac{\delta z}{\delta x} = \frac{dQ}{dz}$$

Since from $z = x + iy$, $\delta z/\delta x = 1$

Introducing $V_x$ and $V_y$, the velocity components, $$V_x = -\frac{\delta\phi}{\delta x},\ V_y = \frac{\delta\psi}{\delta x}$$

and substituting, the following relation is obtained:

$$-\frac{dQ}{dz} = V_x - iV_y$$

Where $-dQ/dz$ is called the complex velocity, $\omega$.

Since $\phi$ and $\psi$ satisfies the Cauchy-Riemann equations, $\omega$ must satisfy them also as both $V_x$ and $V_y$ are analytic functions of $\phi$ and $\psi$. Hence, $\omega$ is an analytic function of the complex variable, $z = x + iy$, where $(x,y)$ are the rectangular coordinates in the flow field shown in FIG. 4. Thus, $$\omega(z) = V_x(x,y) - iV_y(x,y)$$

Full descriptions of the concepts set forth above may be found in the standard works on fluid mechanics. Rewriting $\omega$ as follows, $$\omega(z) = V\infty\,[1 + u(x,y) - iv(x,y)],$$

it follows that a new function $\omega(z) = u(x,y) - iv(x,y)$, which is called the complex perturbation velocity, is also an analytic function in the same region as $\omega(z)$. $\omega(z)$ satisfies the Cauchy-Rieman equations; hence, both the continuity equation $$\frac{\delta u(x,y)}{\delta x} = -\frac{\delta v(x,y)}{\delta y}$$

and the condition of irrotational flow $$\frac{\delta u(x,y)}{\delta y} = \frac{\delta v(x,y)}{\delta x}$$

are satisfied. Note that $$u(x,y) = \frac{V_x(x,y) - V_\infty}{v_\infty}, \qquad v(x,y) = \frac{Vy(x,y)}{V_\infty}$$

so that $u$ and $v$ are dimensionless quantities and are the ratios of the foil induced velocity components to the free stream velocity, also all length measurements are normalized with respect to the chord, C.

The basic assumptions of linearized theory is that the magnitudes of the perturbation disturbance velocities, $(u,v)$ due to the presence of the both in the main stream, are small in comparison to the magnitude of the free-stream velocity, $V_\infty$. As a consequence of the small disturbance assumption, the flow conditions on the actual body and cavity surfaces may be evaluated on the horizontal plane y=o aligned with the free-stream velocity. The boundary conditions of this problem can be determined as follows: At $z=\infty$, $u=v=o$, this condition is exact. In order to simplify the boundary condition on the cavity boundary and on the wetted surface of the hydrofoil, it is assumed that both the camber and the angle of attack are small quantities of the first order. Squares and higher powers of these quantities can be neglected. Under this condition, since $\sigma=0$, the cavity, which starts from an arbitrary chordwise location on the upper surface and the trailing edge of the bottom surface of the foil, extends to infinity with a slender configuration. It is reasonable to assume that, except for gravitational effects which are neglected, the cavity is aligned in the undisturbed flow direction. On the cavity boundary it is assumed that the flow velocity is equal to the free-stream velocity; and hence, $u=0$. On the wetted surface of the hydrofoil, the flow must be tangent to the solid surface, hence $$\frac{\delta y}{\delta x} = \frac{V}{1+u} \simeq V$$

where, $y$ is the hydrofoil coordinate.

On the free surface, $y=h$ the linearized Bernoulli's equation becomes $u = -g\lambda/V_\infty^2 \simeq 0$ when the Froude number based on the wave height, $\lambda$, is very large. On the wetted surface using Bernoulli's equation and linearizing, it follows that $$C_p = \frac{P - P_\infty}{g} \simeq -2u$$

Figure 5:
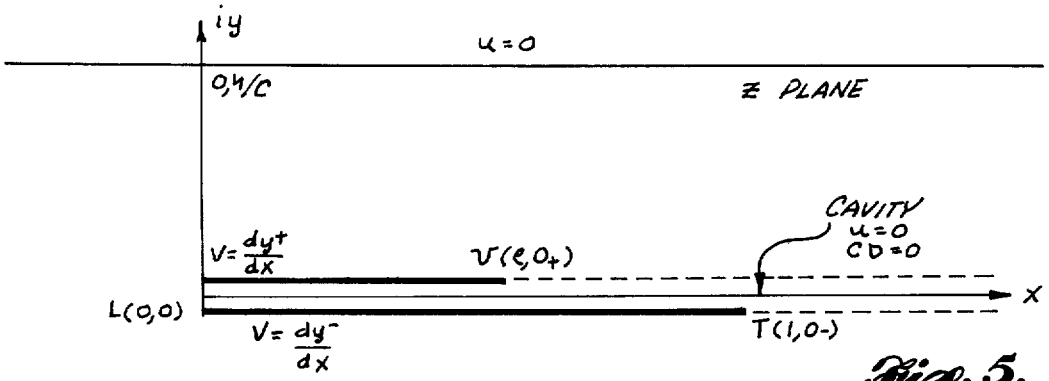
FIG. 5 shows a linearized hydrofoil plane showing the boundary conditions observed in hydrofoil operations.

The above boundary conditions are shown in FIG. 5.

CONFORMAL MAPPING

Figure 6:
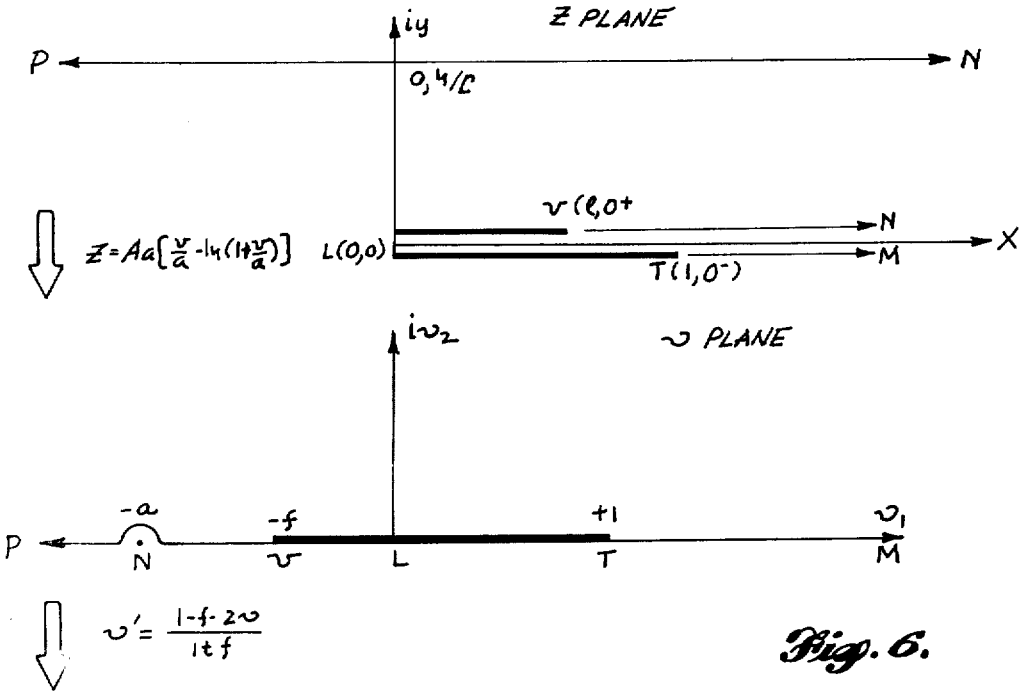
FIG. 6 shows graphically one portion of the conformal transformation utilized in design of the hydrodynamic sections of this invention.
Figure 7:
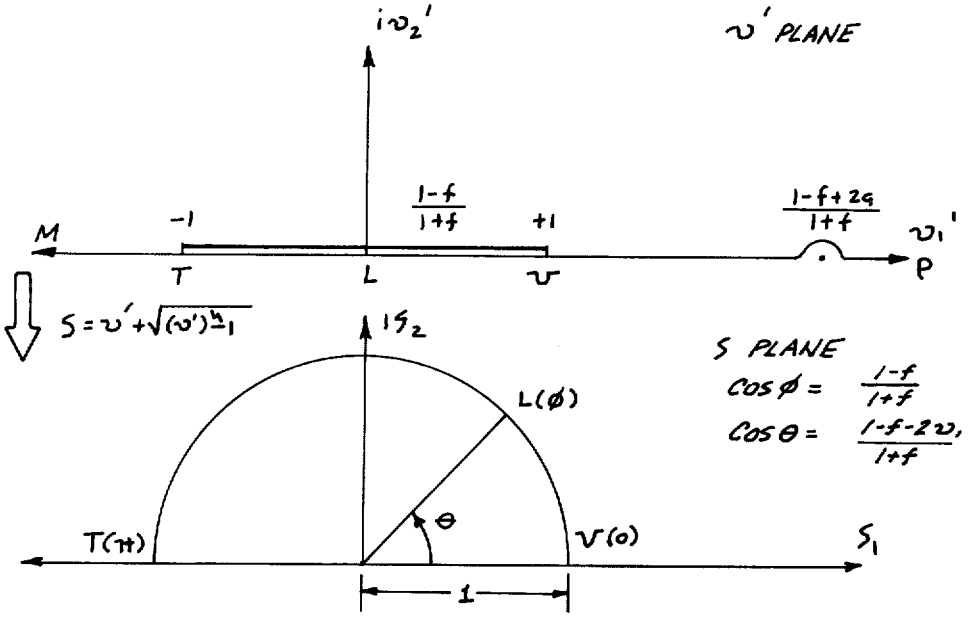
FIG. 7 shows another graphical representation of a subsequent step in the conformal transformation utilized in solving the design problem stated herein.

By the use of a Schwarz-Christoffel transformation the line $y = h$ and the semi-infinite line $y = 0$, $x>0$, is transformed onto the real axis of the $v$ plane where, $v=v_1+iv_2$, while the whole $z$ plane is mapped onto the lower half of the v plane as shown in FIG. 6. The required transformation is then:

$$\frac{dz}{dv} = \underset{(\text{at } P)}{C_1 C_2} \quad \underset{(\text{at } N)}{[v-(-a)]^{\theta-1}(v-o)} \quad \underset{(\text{at } L)}{\frac{2\pi}{\pi}-1} \quad \underset{(\text{at } M)}{C_3}$$

$$= \frac{A^v}{v+a} \qquad = A\,\frac{v/a}{1+v/a}$$

by specifying the following points in the transformation:

1. $x=-\infty$, $y=h$ to $v_1=-\infty$
2. $x=+\infty$, $y=o^+$ to $v_1=-a$
3. $x=o$, $y=o$ to $v_1=o$
4. $x=+8$, $y=o^-$ to $v_1=+\infty$ Integrating the above equation — and applying the condition $v=o$ at $z=o$, the following transformation is obtained:

$$z = Aa\,[v/a - \ln(1+v/a)]$$

and by equating real and imaginary parts $$x = Aa\,[v_1/a - \ln(1+v_1/a)]$$
$$y = Aa\,[v_2/a - \text{argument } v]$$

By further specifying that the trailing edge of the plate $x = 1$, $y = o^-$ be transformed into $v_1=+1$, the venting location on the upper surface $x=e$, $y=o^+$ into $v_1=-f$, and the change in the imaginary value of $z$ as $v$ goes through $v_1=-a$ as $y=h/c$, the following equations are obtained:

$$\frac{1}{A} = 1 - a\ln\left(1 + \frac{1}{a}\right)$$

$$e = Aa[-f/g - \ln(1-f/g)]$$

and $y = h/c = Aa\,[o-(-\pi)] = Aa\pi$ since $V_z=o$ and the $z$ plane is mapped into the lower $v$ plane, argument $v = -\pi$ at $v_1 = -a$.

Conformal mapping was applied to map the $v$ plane onto the upper half of the $z$ plane outside the unit circle $y = 1$, as shown in FIG. 6. The first transformation $$v^1 = \frac{1-f-2v}{1+f}$$

stretches the hydrofoil venting location $v$ to the +1 location on the $v^1$ real axis and maps the lower half of the $v$ onto the upper half of the $v^1$ plane. The second transformation is a Joukowsky transformation of the form $$v^1 = \frac{\zeta^2+1}{2\zeta} \qquad \text{or } \zeta = v^1 + \sqrt{(v^1)^2-1}$$

which maps the wetted surface of the hydrofoil onto the upper half of the unit circle, $\delta = 1$.

For points on the unit circle for which $\delta$ is equal to $1e^{i\Theta}$, the corresponding value of $x$ on the wetted surface was found by $$\delta = e^{i\Theta} = \cos\theta + i\sin\theta = v^1 + i\sqrt{1-(v^1)^2} = v_1^1 + i\sqrt{1-(v_1^1)^2},$$

since $v_2^1 = o$ $$\cos\theta = v_1^1 = \frac{1-f-2v}{1+f} = \frac{1-f-2v_1}{1+f}, \qquad \text{since } v_2 = o$$

$$v_1 = \frac{1-f-(1+f)\cos\theta}{L} = \frac{K-\cos\theta}{L}$$

where $$K = \frac{1-f}{1+f}, \qquad L = \frac{2}{1+f}$$

thus, $$x = Aa\left[\frac{K-\cos\theta}{AL} - \ln\frac{(aL+K-\cos\theta)}{aL}\right]$$

$$= Aa\left[\frac{K-\cos\theta}{aL} - \ln\frac{(P-\cos\theta)}{aL}\right]$$

where $$P = K + aL$$

Differentiating, it is found that $$\frac{dx}{d\theta} = \frac{A}{L}(\sin\theta)\frac{K-\cos\theta}{P-\cos\theta}$$

The foil leading edge in the $\delta$ plane is given by $$\cos\phi = \frac{1-f}{1+f}K$$

* Superscript designates Reference number.

To determine a section shape at given $h/c$ given a $C_p$ basic distribution then the mean line is given by $$Y_c'(\theta_o) = -\frac{1}{2\pi}\int_0^{\pi}\frac{C_{P_{Basic}}\sin\theta}{\cos\theta-\cos\theta_o}d\theta;$$

where $$Y'_c = \frac{dY_c}{d\theta}$$

and the thickness distribution is given by $$\frac{Y'(\theta_o)}{\sqrt{\rho}} = -\frac{2}{1+f}\frac{\sqrt{a/A}}{\cos\phi-\cos\theta_o};$$

where $$Y' = \frac{dY}{d\phi}$$

where $\sqrt{\rho}$ = parabolic thickness term thus defining the basic parameters necessary for design of a hydrodynamic section exhibiting the desired pressure profile.

Figure 8:
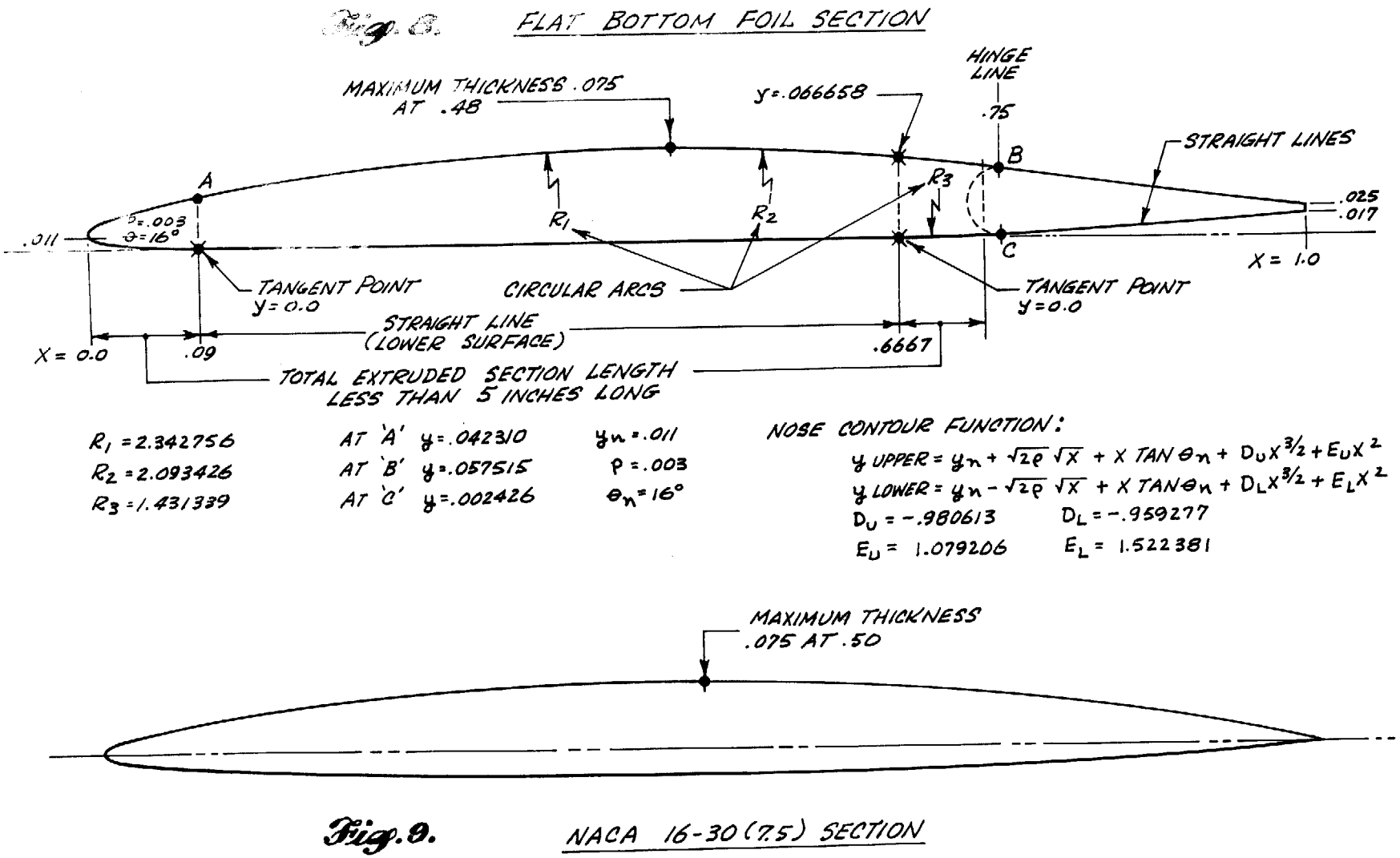
FIG. 8 shows one foil section meeting many of the design criteria for the hydrodynamic section of this invention.
Figure 10:
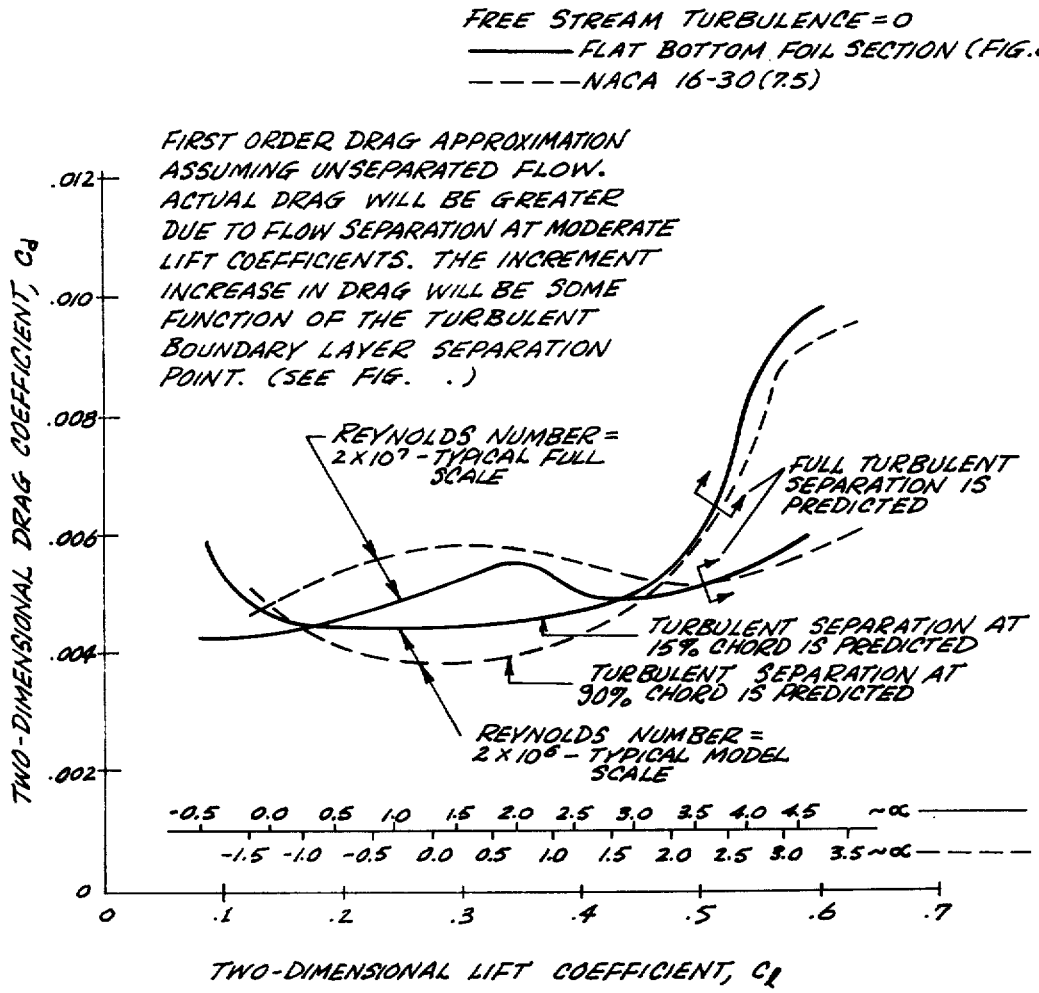
FIG. 10 is a graphical representation of the operating characteristics of the foil section shown in FIG. 8.

In FIGS. 8, 10 and 11 one hydrodynamic foil meeting many of the design criteria set forth above is shown. This flat bottom foil section is constructed having a major portion of the bottom flat with a major portion of the upper surface defined by three circular arcs as shown. Nose contour and tail section are shown as designed to provide a positive pressure at the leading edge stagnation region and a positive pressure on the foil at the trailing edge stagnation region. The shape shown provides a kinked portion in both the upper surface and lower surface pressure profiles to provide the desired influence over cavitation and unwetting of the foil.

For comparison the NACA 16–30(7.5) section is shown in FIG. 9. The curved bottom thereon causes a negative pressure on the lower surface as described in FIG. 2 for uncambered passage through a liquid.

While the inventors have described their invention with reference to specific embodiments, it will be apparent to those skilled in the art that modifications may be made within the scope of this invention.

The embodiments of the invention in which an exclusive property or privilege is claimed are defined as follows:

1. A longitudinal hydrofoil section having an elongated axis, a contoured nose, and first and second surfaces, the cross section of said hydrofoil section being geometrically defined with respect to a normalized cartesian coordinate system, wherein $x$ represents the abscissa and $y$ represents the ordinate, as follows:

the distance between $x = 0$ and $x = 0.09$ forming the contoured nose and being defined by the following equations:

$$Y_{UPPER} = Y_n + \sqrt{2\rho}\sqrt{x} + x\,\mathrm{TAN}\,\theta_n + D_U x^{3/2} + E_U x^2$$

$$Y_{LOWER} = Y_n - \sqrt{2\rho}\sqrt{x} + x\,\mathrm{TAN}\,\theta_n + D_L x^{3/2} + E_L x^2$$

wherein:

$Y_n = 0.011$;

$\rho = 0.003$;

$\theta_n = 16°$;

$D_U = -0.980613$; $E_U = 1.079206$; $D_L = -0.959277$; $E_L = 1.522381$;

the first surface between $x = 0.09$ and $x = 0.48$ being defined by a circular arc having a normalized radius equal to 2.342756;

the first surface between $x = 0.48$ and $x = 0.75$ being defined by a circular arc having a normalized radius equal to 2.093426;

the first surface between $x = 0.75$ and $x = 1.0$ being defined by a straight line;

the second surface between $x = 0.09$ and $x = 0.667$ being defined by a straight line lying along the coordinate $y = 0$;

the second surface between $x = 0.667$ and $x = 0.75$ being defined by a circular arc having a normalized radius equal to 1.431339;

the second surface between $x = 0.75$ and $x = 1.0$ being a straight line;

the normalized thickness of said section between the first and second surfaces at $x = 0.09$ being equal to 0.042310;

the normalized thickness of said section between the first and second surfaces at $x = 0.48$ being equal to 0.075;

the normalized thickness of said section between the first and second surfaces at $x = 0.667$ being 0.066658; and, the normalized thickness of said section between the first and second surfaces at $x = 0.75$ being equal to 0.057515 − 0.002426.

2. A hydrodynamic section having an elongated axis and being suitable for use as a boat hydrofoil when moved through a liquid in the direction defined by said elongated axis, said seciton comprising:

first surface means defining a continuous first surface, said first surface contoured such that a negative pressure zone forms over said first surface when said hydrodynamic section is moved through a liquid, said negative pressure zone including a kinked portion rearwardly disposed along said first surface with respect to said direction of travel for stabilizing the boundary layer to prevent liquid separation, the negative pressure of said kinked portion being relatively lower than the negative pressure of the other portions of the negative pressure zone formed over said first surface;

second surface means defining a continuous second surface, said second surface contoured such that a positive pressure zone forms over said second surface when said hydrodynamic section is moved through a liquid, said positive pressure zone including a kinked portion rearwardly disposed along said second surface with respect to said direction of travel for stabilizing the boundary layer to prevent liquid separation, the positive pressure of said kinked portion being relatively lower than the positive pressure of the other portions of the positive pressure zone formed over said second surface;

the mean line between said first and second surfaces being defined by the hydrodynamic equation:

$$Y_c'(\theta_o) = -\frac{1}{2\pi}\int_o^{\pi} \frac{{}^{c}P_{Basic}\sin\theta}{\cos\theta - \cos\theta_o}\,d\theta$$

and wherein the thickness between said first and second surfaces is defined by the hydrodynamic equation:

$$\frac{Y'(\theta_o)}{\sqrt{\rho}} = -\frac{2}{1+f}\,\frac{\sqrt{a/A}}{\cos\phi - \cos\theta_o}$$

wherein:

${}^{c}P_{Basic}$ is a pressure distribution equation having kinked portions located between the midpoints of said hydrodynamic section and said trailing edge;

$Y'_c(\theta_o)$ is the normalized separation distance between the mean line and said elongated axis of the hydrodynamic section at $\theta = \theta_o$;

$\theta$ is the argument of the position vector of the transformed surface;

$\theta_o$ is an arbitrary location of $\theta$;

$Y_t'(\theta_o)$ is the normalized thickness distribution between said surfaces at $\theta = \theta_o$;

$\rho$ is a chosen parabolic thickness distribution constant;

$\Phi$ is the value of $\theta$ at the leading edge; and,

A, $a$ and $f$ are transformation constants determined by the desired pressure distribution;

said first and second surface means joining to define a leading edge, said leading edge being formed such that a positive pressure zone forms about said leading edge when said hydrodynamic section is moved through a liquid; and, said first and second surface means joining to define a trailing edge, said trailing edge being formed such that a positive pressure zone forms about said trailing edge when said hydrodynamic section is moved through a liquid.

3. A hydrodynamic section as claimed in claim 2, wherein said kinked portions are located between the midpoint of said hydrodynamic section and said trailing edge.

* * * * *

UNITED STATES PATENT AND TRADEMARK OFFICE

CERTIFICATE OF CORRECTION

PATENT NO. : 3,946,688
DATED : March 30, 1976
INVENTOR(S) : Robert J. Gornstein et al It is certified that error appears in the above-identified patent and that said Letters Patent are hereby corrected as shown below:

Column 7, line 2, cancel "$\delta$" and insert --$\zeta$--;
line 3, cancel "$\delta$" and insert --$\zeta$--;
line 8, cancel "$\delta$" and insert --$\zeta$--;
lines 28-29, cancel equation as is, and insert therefor:

$$= Aa \left[ \frac{K - \cos\theta}{aL} - \ln \frac{(P - \cos\theta)}{aL} \right]$$

line 40, cancel "$\delta$" and insert --$\zeta$--;
lines 43-44, cancel equation as is, and insert therefor:

$$\cos\phi = \frac{1 - f}{1 + f} = K$$

line 65, cancel equation as is and insert therefor:

$$\frac{Y'(\theta_o)}{\sqrt{\rho}} = -\frac{2}{1 + f} \quad \frac{\sqrt{a/A}}{\cos\phi - \cos\theta_o}$$

Column 8, line 45, cancel equation as is and insert therefor:

$$Y_{UPPER} = y_n + \sqrt{2\rho}\,\sqrt{x} + x \text{ TAN } \theta_n + D_U x^{3/2} + E_U x^2$$

line 46, cancel equation as is and insert therefor:

$$Y_{LOWER} = y_n + \sqrt{2\rho}\,\sqrt{x} + x \text{ TAN } \theta_n + D_L x^{3/2} + E_L x^2$$

UNITED STATES PATENT AND TRADEMARK OFFICE

CERTIFICATE OF CORRECTION

PATENT NO. : 3,946,688
DATED : March 30, 1976
INVENTOR(S) : Robert J. Gornstein et al It is certified that error appears in the above-identified patent and that said Letters Patent are hereby corrected as shown below:

Column 8, line 50, cancel "$Y_n$" and insert --$y_n$--.

Column 9, line 18, delete "seciton" and insert --section--.

Column 10, line 24, cancel "Y't ($\theta_o$)" and insert --Y' ($\theta_o$)--;

line 28, cancel "$\Phi$" and insert --$\phi$--.

Signed and Sealed this

Third Day of August 1976

[SEAL]

*Attest:*

RUTH C. MASON
*Attesting Officer*

C. MARSHALL DANN
*Commissioner of Patents and Trademarks*